US009038306B2

(12) United States Patent
Trapp

(10) Patent No.: US 9,038,306 B2
(45) Date of Patent: May 26, 2015

(54) APPARATUS FOR MOUNTING A SIGHTING MECHANISM ON A HANDGUN

(71) Applicant: J.P. Sauer & Sohn GmbH, Isny (DE)

(72) Inventor: Florian Trapp, Sundern (DE)

(73) Assignee: J.P. SAUER & SOHN GMBH, Isny (DE)

( * ) Notice: Subject to any disclaimer, the term of this patent is extended or adjusted under 35 U.S.C. 154(b) by 85 days.

(21) Appl. No.: 13/925,962

(22) Filed: Jun. 25, 2013

(65) Prior Publication Data

US 2014/0013644 A1 Jan. 16, 2014

(30) Foreign Application Priority Data

Jul. 12, 2012 (DE) ..... 10 2012 014 075

(51) Int. Cl.
*F41G 11/00* (2006.01)

(52) U.S. Cl.
CPC ..... *F41G 11/00* (2013.01); *F41G 11/001* (2013.01); *F41G 11/003* (2013.01)

(58) Field of Classification Search
CPC ..... F41G 11/00; F41G 11/003; F41G 11/004; F41G 11/005; F41G 11/001; F41G 11/002; F41G 1/387; F41G 1/393; F41G 1/3935
USPC ..... 42/124, 125, 126, 127, 148
See application file for complete search history.

(56) References Cited

U.S. PATENT DOCUMENTS

| | | | | |
|---|---|---|---|---|
| 3,862,725 | A * | 1/1975 | Gename | 242/284 |
| 4,531,715 | A * | 7/1985 | Wiens | 254/266 |
| 5,276,988 | A * | 1/1994 | Swan | 42/127 |
| 5,353,539 | A * | 10/1994 | Zeh | 42/124 |
| 5,570,529 | A | 11/1996 | Amelino | |
| 6,622,415 | B1 | 9/2003 | Canaday et al. | |
| 7,272,904 | B2 * | 9/2007 | Larue | 42/127 |
| 7,493,721 | B2 * | 2/2009 | Swan | 42/125 |
| 7,562,485 | B2 * | 7/2009 | Newhall et al. | 42/127 |
| 7,614,175 | B2 * | 11/2009 | Davis et al. | 42/127 |
| 7,739,824 | B1 * | 6/2010 | Swan | 42/124 |
| 7,757,422 | B1 * | 7/2010 | Swan | 42/96 |
| 7,757,423 | B1 * | 7/2010 | Swan | 42/127 |
| 7,802,395 | B1 * | 9/2010 | Swan | 42/127 |
| 7,886,476 | B1 * | 2/2011 | Swan | 42/127 |
| 7,905,045 | B1 * | 3/2011 | Swan | 42/127 |
| 7,908,782 | B1 * | 3/2011 | LaRue | 42/128 |
| 7,913,441 | B1 * | 3/2011 | Reed | 42/124 |
| 8,112,933 | B1 * | 2/2012 | Swan | 42/127 |
| 8,132,355 | B1 * | 3/2012 | Kincaid et al. | 42/124 |
| 8,156,679 | B1 * | 4/2012 | Swan | 42/124 |

(Continued)

FOREIGN PATENT DOCUMENTS

| | | | |
|---|---|---|---|
| DE | 4229089 | A1 | 3/1994 |
| DE | 202009003210 | U1 | 7/2010 |

*Primary Examiner* — Troy Chambers
*Assistant Examiner* — Joshua Freeman
(74) *Attorney, Agent, or Firm* — Fleit Gibbons Gutman Bongini & Bianco PL; Martin Fleit; Paul D. Bianco

(57) ABSTRACT

The invention relates to an apparatus for mounting a sighting mechanism on a handgun, with a bracket (2), comprising at least a fixed bracket element and a rotatable bracket element (5) opposite thereto that is rotatable on an axis (20) relative to the bracket (2), which is adjustable by an operating element (19) opposite the fixed bracket element (3). To enable a precisely repeatable and low-wear mounting, the operating element (19) is rotatable relative to the rotatable bracket element (5) on the axis (20) thereof.

7 Claims, 4 Drawing Sheets

(56) References Cited

U.S. PATENT DOCUMENTS

| | | | | |
|---|---|---|---|---|
| 8,230,636 | B1 * | 7/2012 | Swan | 42/124 |
| 8,336,247 | B2 * | 12/2012 | Haering | 42/127 |
| 8,397,421 | B2 * | 3/2013 | Ding et al. | 42/124 |
| 8,499,484 | B2 * | 8/2013 | Schneider et al. | 42/124 |
| 8,510,983 | B2 * | 8/2013 | Larue | 42/148 |
| 8,578,647 | B2 * | 11/2013 | Storch et al. | 42/124 |
| 8,667,727 | B2 * | 3/2014 | Engelhardt | 42/124 |
| 8,701,327 | B2 * | 4/2014 | Kincel | 42/90 |
| 8,701,331 | B2 * | 4/2014 | Schneider et al. | 42/124 |
| 8,752,325 | B2 * | 6/2014 | Ding et al. | 42/90 |
| 8,769,859 | B2 * | 7/2014 | Li et al. | 42/124 |
| 2001/0027620 | A1 * | 10/2001 | Wooten et al. | 42/124 |
| 2006/0117636 | A1 * | 6/2006 | Newhall et al. | 42/124 |
| 2006/0123686 | A1 * | 6/2006 | Larue | 42/127 |
| 2006/0207156 | A1 * | 9/2006 | Larue | 42/127 |
| 2008/0134559 | A1 * | 6/2008 | Swan | 42/90 |
| 2008/0216380 | A1 * | 9/2008 | Teetzel | 42/127 |
| 2009/0151484 | A1 * | 6/2009 | Mullen et al. | 74/47 |
| 2009/0288328 | A1 * | 11/2009 | Kiser | 42/124 |
| 2010/0031553 | A1 | 2/2010 | Couture et al. | |
| 2010/0313462 | A1 * | 12/2010 | Holmberg | 42/124 |
| 2011/0023348 | A1 * | 2/2011 | Karagias | 42/124 |
| 2011/0061286 | A1 * | 3/2011 | Wang | 42/125 |
| 2011/0076095 | A1 * | 3/2011 | Storch et al. | 403/322.4 |
| 2011/0138667 | A1 | 6/2011 | Bolden | |
| 2011/0271578 | A1 * | 11/2011 | Karagias | 42/124 |
| 2013/0047486 | A1 * | 2/2013 | Ding et al. | 42/124 |
| 2013/0160345 | A1 * | 6/2013 | Li et al. | 42/124 |
| 2013/0212923 | A1 * | 8/2013 | Schneider et al. | 42/124 |
| 2014/0013644 | A1 * | 1/2014 | Trapp | 42/90 |

* cited by examiner

APPARATUS FOR MOUNTING A SIGHTING MECHANISM ON A HANDGUN

CROSS REFERENCE TO RELATED APPLICATIONS

This application claims priority under 35 U.S.C. §119 to German Patent Application No. 10 2012 014 075.4 filed 12 Jul. 2012, the entire contents of which are incorporated herein by reference.

FIELD OF THE INVENTION

The invention relates to an apparatus for mounting a sighting mechanism on a handgun.

BACKGROUND OF THE INVENTION

A mounting apparatus of this kind is disclosed in DE 42 29 089. Therein, on the front and back ends of a bridge-shaped bracket are respectively deployed, as bracket elements: on one side, a fixed clamp, and on the opposite side, an adjustable clamp. The adjustable clamp is implemented as a single unit with an operating element implemented as a swing arm, and connected to the bracket via a threaded connection. The mounting apparatus is fitted to a handgun in such a way that only the fixed clamp can be engaged with the corresponding blind holes in the handgun. Subsequently, the clamp is rotated via the swing arm from a release position to a clamping position. Due to the threaded connection, the clamp thus moves along with the shaped swing arm in the direction of the handgun, and comes into contact with the corresponding cut-outs of the handgun. By a further rotation of the clamp, the apparatus is locked to the handgun. Wear and tear or signs of use may occur due to frictional wear, especially in the case of delicate surfaces, due to the rotation of the clamp across the cutouts of the handgun that occurs during fastening.

SUMMARY OF THE INVENTION

One aspect of the invention is to furnish an apparatus for the mounting of a sighting mechanism of the above-described kind, which enables the mounting to be done with repeat accuracy and low wear.

In the case of an embodiment of the apparatus of this invention, the operating element is implemented so as to be rotatable relative to the rotatable bracket element, around the rotational axis thereof. Such an embodiment enables relative movement between the operating element and the bracket element, which has the advantage that the bracket element can be decoupled from the rotation of the operating element when locked to the handgun. During clamping, the initially rotatable clamping element can only be pressed in without further rotation, so that there is no abrasion of the clamping element and handgun. This efficaciously enables the reduction of wear on the contact points and ensures a precise connection with repeat accuracy.

In a preferred embodiment, the operating element is connected to the rotatable bracket element in such a way that when the operating element is rotated, the rotatable bracket element is initially rotated along with it into a clamping position, and after reaching a locking position, can only be pushed in the direction of the axis of rotation, unless it is rotated further. The locking position should preferably be selected in such a way that in this position, either the rotatable bracket element no longer has any contact with the handgun, or the rotatable bracket element has only just come into contact with the handgun. After reaching the locking position, the rotatable bracket element undergoes no further rotation when the operating element is rotated into clamping position, but is only pushed against the fixed bracket element.

In order to define the locking position and a release position of the rotatable bracket element, the rotation of the bracket element can be restricted with respect to the bracket. The rotation of the bracket element together with the operating element can thus take place by means of a snap fitting. A snap fitting has the advantage that it can be released non-destructively, as soon as the rotation of the operating element is continued beyond the limit of the bracket element in locking position.

An especially precise and robust restriction of the rotation of the rotatable bracket element with respect to the bracket can be achieved by engaging a projection deployed on the rotatable bracket element with a cam furnished on the bracket.

In a further preferred embodiment, the snap fitting is configured as a locking ball deployed on the operating element and a running groove with a locking recess on the rotatable bracket element. By applying sufficient force against the spring tension, the ball can be lifted out of the locking recess.

To ensure robust mounting of the rotatable bracket element, it can be deployed on a threaded pin deployed on the bracket such that it is rotatable around the axis thereof.

The rotation of the operating element together with adjustment can be advantageously accomplished by a threaded connection of the operating element to the threaded pin.

An especially space-saving configuration is realized by an operating element with a swing arm and a folding grip. When folded out, the grip affords a good lever arm for the operation of the swing arm, and when folded closed, on the other hand, the operating element needs little room and the risk of damage due to protruding parts is reduced.

It is also preferred that an additional projection be furnished on the rotatable bracket in order to be caught by the operating element. By this additional projection, the relative rotation between the operating element and bracket element can be restricted with precision.

In an especially robust and easily assembled embodiment, the bracket mechanism is implemented in the form of a mounting bridge with a fixed bracket and an opposing adjustable bracket on a front and back end. The bracket can however also be realized as a unitary assembly. Also, by means of two, e.g. ring-shaped, unitary assemblies, a sighting scope or other sighting mechanism can be fastened to a handgun.

BRIEF DESCRIPTION OF THE DRAWINGS

Further characteristics and advantages of the invention are presented in the following description of a preferred embodiment, with reference to the drawings. These are.

DETAILED DESCRIPTION OF THE INVENTION

Figure 1:
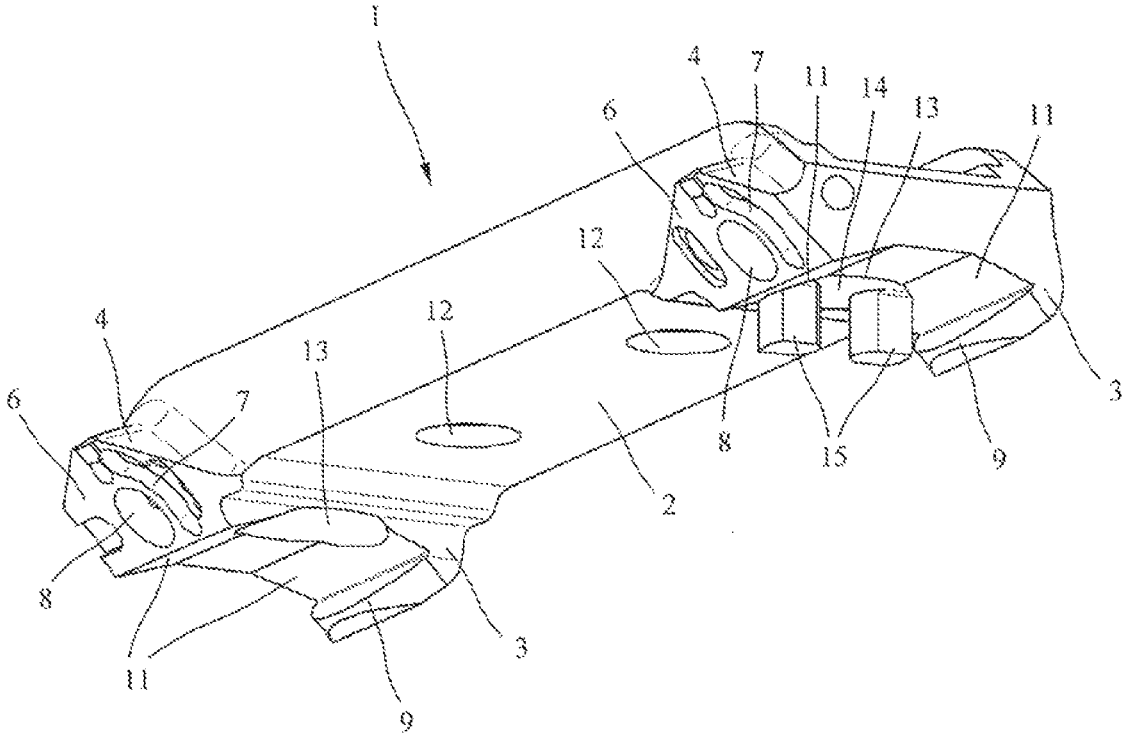
FIG. 1: an apparatus for mounting a sighting mechanism on a handgun without adjustable bracket elements, from one perspective.
Figure 2:
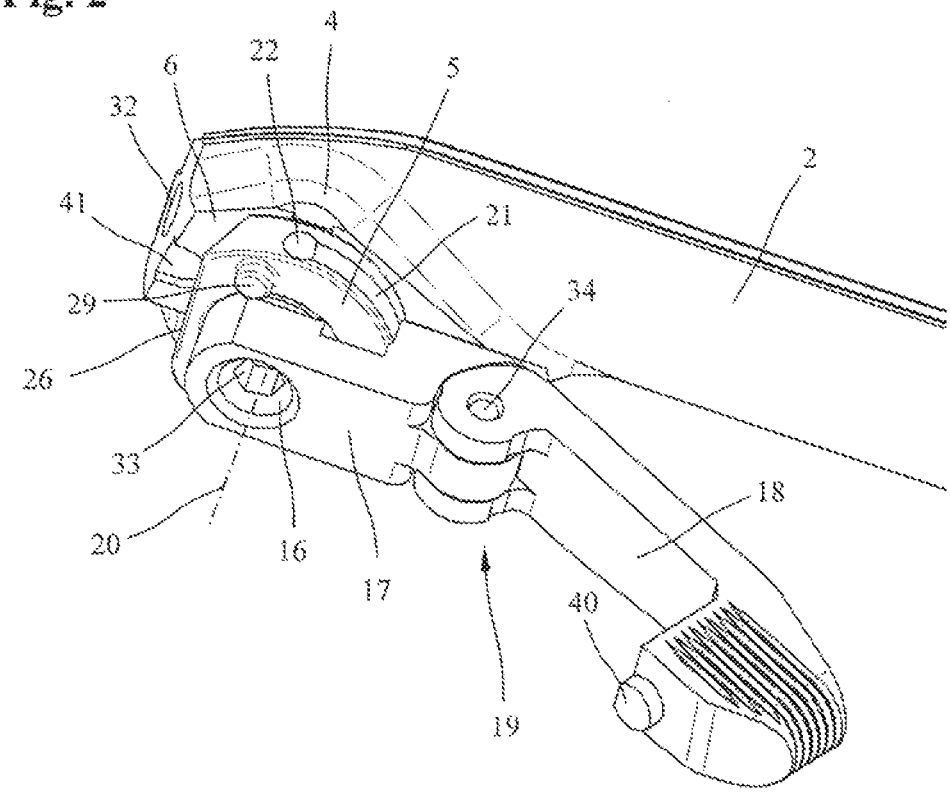
FIG. 2: one part of the mounting apparatus of FIG. 1 with an adjustable bracket element and an arm in folded-out position, from one perspective.
Figure 3:
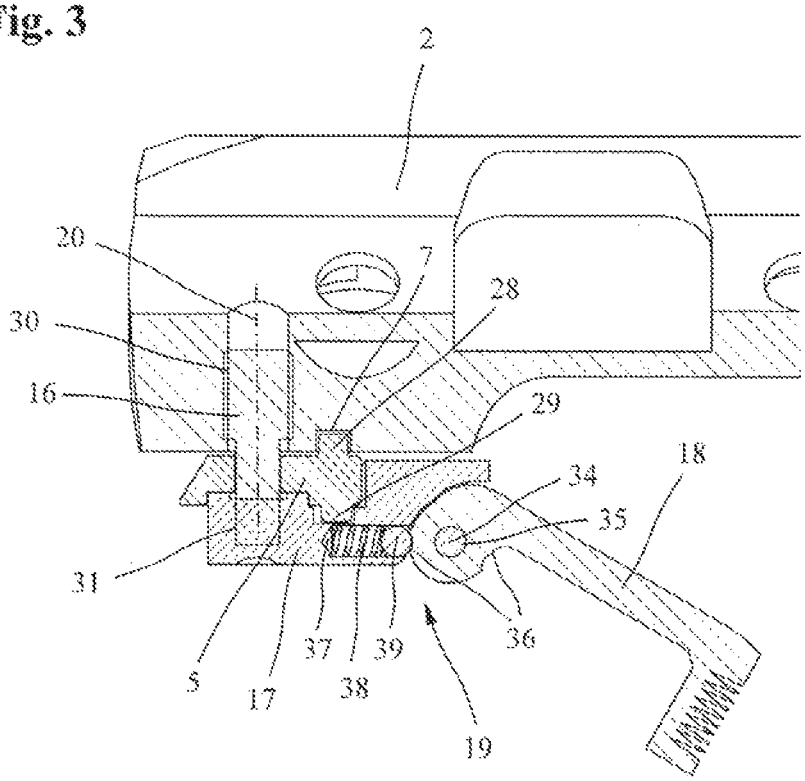
FIG. 3: the part of the mounting apparatus shown in FIG. 2, with the adjustable bracket element in a sectional view.

The apparatus 1 shown in FIG. 1 for mounting a sighting mechanism on a handgun comprises a bracket 2, formed here as a mounting bridge, that has a fixed bracket element 3 and an opposing receiver 4, at both its front and back ends, for the rotatable bracket element 5 shown in FIGS. 2 and 3. The two receptacles 4 contain inclined exterior faces 6, with a cam 7 and a threaded hole 8 for an operating mechanism depicted in FIGS. 2 and 3 and described in greater detail hereinbelow for rotating and pushing the rotatable bracket element 5. Both the fixed bracket elements 3, which are formed as fixed jaws, and also the rotatable bracket elements 5, which are implemented as adjustable jaws, possess, as shown in FIG. 6, a clamping area 9 or 10 furnished with inclined faces for engaging with a receiver housing of the handgun at corresponding depths.

As is also evident from FIG. 1, there are furnished, at the front and rear ends on the underside of the arch-shaped bracket 2, inclined seat-engaging surfaces 11 that seat onto the roof-shaped seating surfaces on the mounting bases of the receiver housing. Within the bracket, holes 12 and 13 are deployed for accommodating screws, etc., for fastening, e.g. ring brackets or other brackets for a sighting scope or other sighting mechanism. In one of the holes 13 on the underside of the bracket 2 there is additionally installed a recoil lug 14 with two protruding engagement elements 15, spaced apart from one another, to afford a form-locking engagement with the two spaced-apart groove-shaped recesses in the receiver housing 1.

The operating mechanism for adjusting the rotatable and slidable bracket element 5 comprises: a threaded pin 16 inserted within the threaded hole 8 of the bracket 2, and an operating element 19, here realized as a swing arm 17 with a folding grip 18, by the clockwise rotation whereof the bracket element 5, which is rotatable on an axis 20, is carried along, and after being rotated by 90°, unless it is rotated further, it is only pushed against the fixed bracket element 3.

Figure 4:
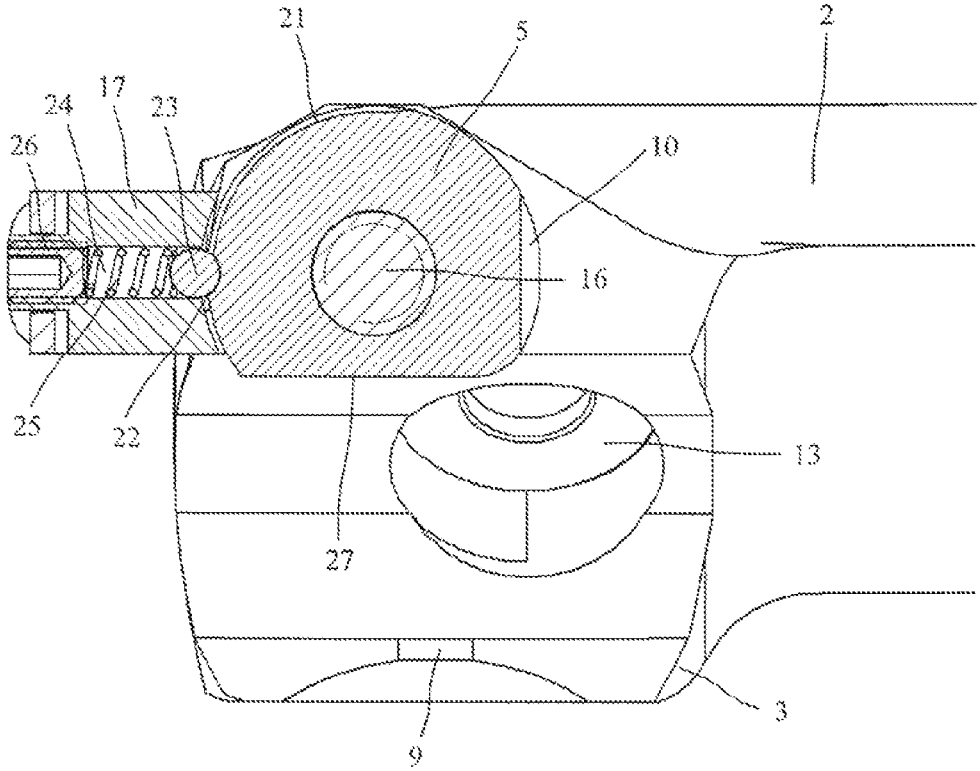
FIG. 4: a sectional view of the adjustable bracket element in the released position.
Figure 5:
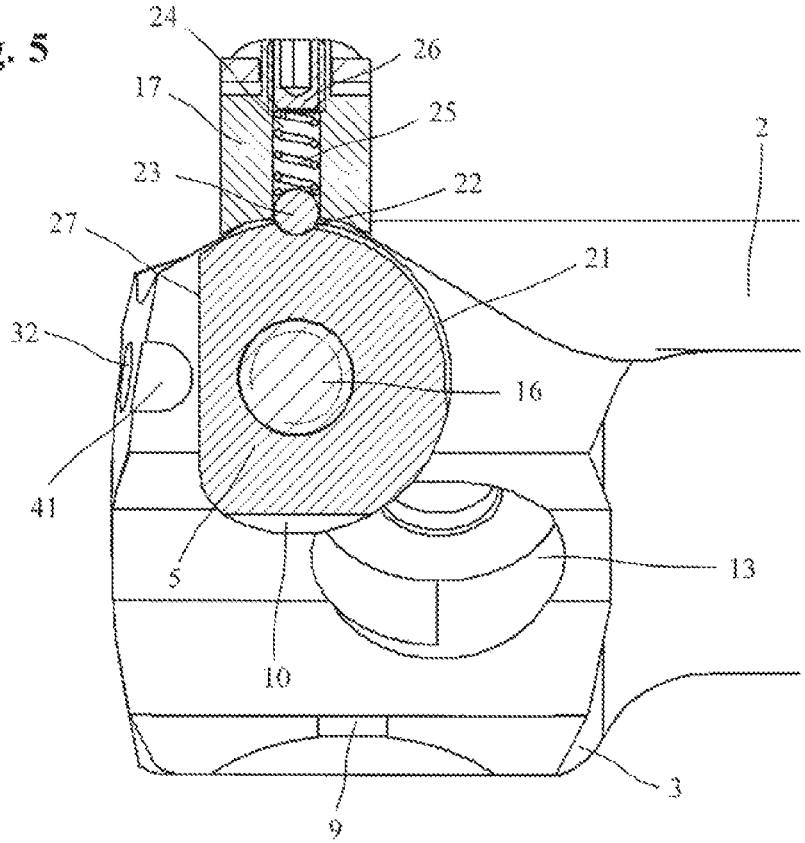
FIG. 5: a sectional view of the adjustable bracket element in an intermediate position.
Figure 6:
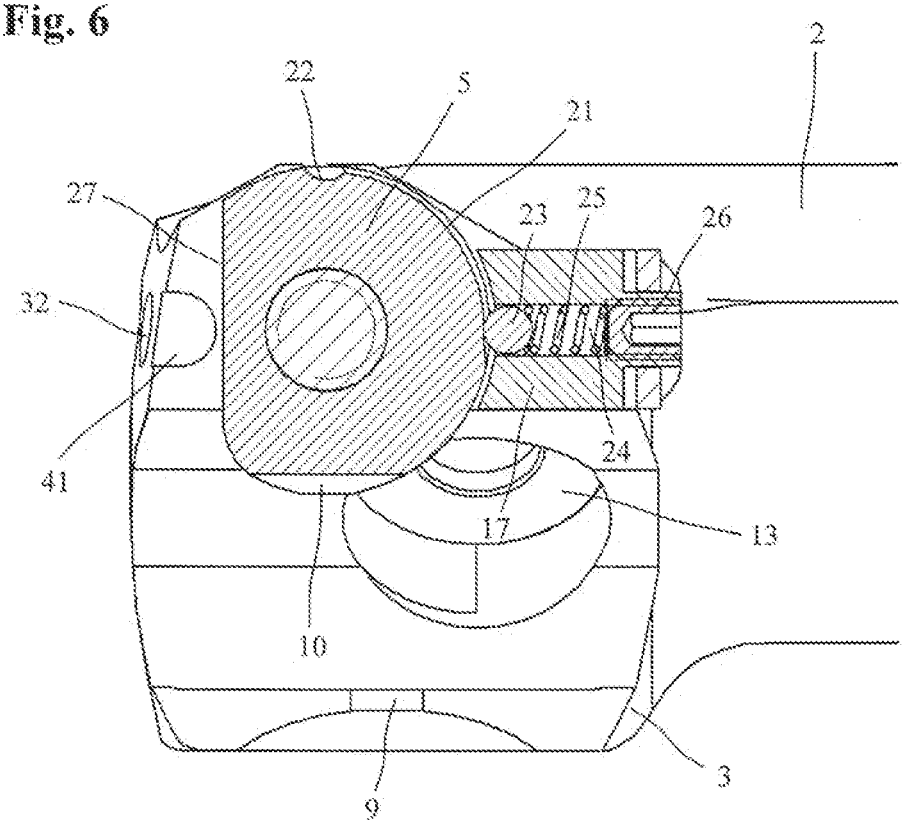
FIG. 6: a sectional view of the adjustable bracket element in the clamped position

The rotatable bracket element 5, as shown in FIG. 2, thus possesses on its outer periphery a running groove 21 running over an angle of 90° in the circumferential direction with a locking recess 22 at the end for receiving a locking ball 23 deployed in the swing arm 17 and depicted in FIGS. 4-6.

Figure 7:
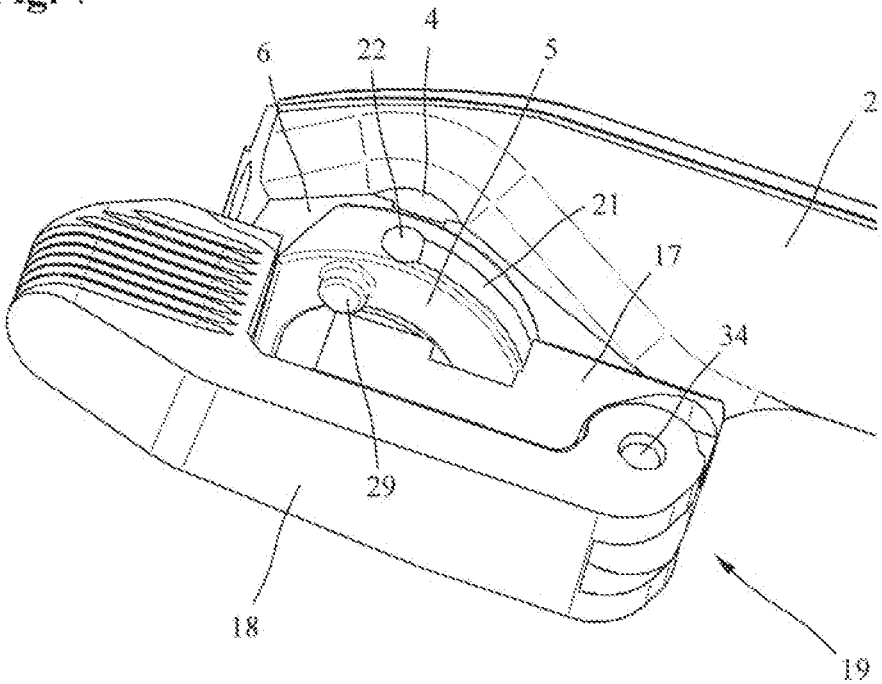
FIG. 7: a part of the mounting apparatus of FIG. 1 with an adjustable bracket element and closed arm, from one perspective.

From FIGS. 4-6, it is evident that the first locking ball 23 is deployed in a radial hole 24 of the swing arm 17, and is pushed into the running groove 21 by means of a first spring 25. For adjustment of the pressing force of the locking ball 23, the first spring 25 is gripped between the first locking ball 23 and an adjustment screw 26. The rotatable bracket element 5 is implemented in the form of a disk with a flattened part 27 and a clamping area 10 offset in a circumferential direction with respect to the flattened part 27. The inclined clamping area 10 is offset by 90° with respect to the flattened part 27, so that the clamping area 10 can be rotated by rotating the bracket element 5 by 90° between a release position shown in FIG. 4 and a locking position shown in FIG. 5. In order to restrict rotation of the bracket element 5 to 90° between the release position and the locking position, the adjustable bracket element 5 has on its internal side, facing the outer surface 6 of the bracket 2, a projection 28 that projects inward to engage with a cam 7 that runs in an arc over an angle of 90°. On the outer side of the rotatable bracket element 5 is additionally furnished a projection 29 that projects outward, visible in FIGS. 3 and 7, which extends by a 90° rotation from the clamp position shown in FIG. 7 to the contact with the swing arm 17 when the swing arm 17 is opened, and carries the bracket element 5 along in a further rotation of 90°.

The rotatable bracket element 5, realized in the form of a disk, is rotatably seated around the axis 20 on the threaded pin 16, which, as shown in FIG. 3, comprises a fine pitch thread 30 at its internal end, deployed within the threaded hole 8 of the bracket 2, and a metric thread 31 for connecting with the swing arm 17 on its opposite, outer end, which projects outward against the bracket 2. By means of an Allen screw, not shown, within a cross hole 32 in the bracket 2, shown in FIG. 2, the threaded pin 16, which is rotatable via a hexagonal socket 33 for mounting and adjustment, can be fixed within the bracket 2 after adjustment. The swing arm 17 can be rotated more simply via the fold-out grip 18.

As is evident from FIG. 3, the grip 18 is hinged on the swing arm 17 in such a way that it can swing by means of a cross pin 34 for folding and unfolding. The grip 18 has a rounded inner end with a cross hole 35 for the cross pin 34, and an angular outer end. On the outer side of the rounded internal end there are furnished two locking recesses 36 for a second locking ball 39 that is deployed within a blind hole 37 of the swing arm 17 and is pushed outward by a second spring 38. The grip 18 has a pin 40, shown in FIG. 2, on the inside of its angular outer end, which, in the folded position of FIG. 7, engages with a recess 41 in the inclined outer face 6 of the bracket 2. Accidental opening of the swing arm 17 can thus be averted.

In the following, the operation of the above-described mounting apparatus will be described with reference to FIGS. 4-6.

In the release position shown in FIG. 4, the rotatable bracket element 5 is pivoted in such a way that the flattened part 27 points to the clamping area 9 of the fixed bracket element 3. In this release position, the bracket 2 can readily be attached to the handgun or removed therefrom. In the release position, the swing arm 17 is deployed in such a way that the locking ball 23 is seated in the locking recess 22 of the running groove 21.

After the attachment of the bracket 2 to the handgun, the swing arm 17 is rotated 90° clockwise as shown in FIG. 5. The rotatable bracket element 5 is thus carried along clockwise by the ball lock. The projection 28 that projects from the reverse side of the adjustable bracket element 5 is thus guided frictionlessly into the cam 7 of the bracket 2. As soon as the bracket element 5 carried along by the swing arm 17 reaches the position shown in FIG. 5, further rotation of the bracket element 5 is averted by the reverse-side projection 28. The adjustment of the operating mechanism thus occurs in such a way that the bracket element 5 does not touch the receiver housing of the handgun when the swing arm 17 is swiveled inward into the intermediate position of FIG. 5.

Not until the swing arm 17 is rotated another 90° to the clamping position of FIG. 6 is the bracket element 5 pushed against the pitch of the thread 31 and up to the fixed bracket element 3, without further rotation of the swing arm 17. Because the bracket element 5 does not undergo rotation when actually clamped, but is only pushed transversely to the receiver housing, damage to the handgun due to frictional wear can be prevented.

What is claimed is:

1. An apparatus for mounting a sighting mechanism on a handgun, with a bracket, comprising a fixed bracket element and a rotatable bracket element opposite thereto that is rotatable relative to the bracket on a rotational axis, which is adjustable by an operating element opposite the fixed bracket element, wherein the operating element is rotatable relative to the rotatable bracket element on the axis thereof, wherein the rotation of the rotatable bracket element against the bracket is restricted, and the rotatable bracket element is connected to the operating element via a snap fitting, and wherein the rotation of the rotatable bracket element against the bracket is restricted by the engagement of a projection, deployed on the rotatable bracket element, with a cam furnished in the bracket.

2. The apparatus of claim 1, wherein the operating element is connected to the rotatable bracket element in such a way that the rotatable bracket element is initially carried along with a rotation of the operating element into a clamping position, and after reaching a locking position, is only pushed in the direction of the rotational axis without rotating further.

3. The apparatus of claim 1, wherein the snap fitting is formed as a locking ball deployed in the operating element and a running groove with a latching depression in the rotatable bracket element.

4. An apparatus for mounting a sighting mechanism on a handgun, with a bracket, comprising a fixed bracket element and a rotatable bracket element opposite thereto that is rotatable relative to the bracket on a rotational axis, which is adjustable by an operating element opposite the fixed bracket element, wherein the operating element is rotatable relative to the rotatable bracket element on the axis thereof, wherein the rotatable bracket element is rotatably deployed around the rotational axis on a threaded pin deployed in the bracket, and wherein the threaded pin is deployed in the bracket with a fine-pitch thread and secured against rotation.

5. The apparatus of claim 4, wherein the operating element is connected to the threaded pin via a thread.

6. The apparatus of claim 1, wherein the operating element is formed as a swing arm with a folding grip.

7. The apparatus of claim 1, wherein the rotatable bracket element contains an additional projection for catching the operating element.

* * * * *